United States Patent [19]

Reinehr et al.

[11] Patent Number: 5,015,428

[45] Date of Patent: May 14, 1991

[54] PAN DRY SPINNING PROCESS OF INCREASED SPINNING CHIMNEY CAPACITY USING SUPERHEATED STEAM AS THE SPINNING GAS MEDIUM

[75] Inventors: Ulrich Reinehr; Günter Türck; Rolf B. Hirsch; Hermann-Josef Jungverdorben, all of Dormagen, Fed. Rep. of Germany

[73] Assignee: Bayer Aktiengesellschaft, Leverkusen, Fed. Rep. of Germany

[21] Appl. No.: 408,861

[22] Filed: Sep. 18, 1989

[30] Foreign Application Priority Data

Sep. 28, 1988 [DE] Fed. Rep. of Germany ..... 3832871

[51] Int. Cl.[5] ..... D01D 5/04; D01F 6/18

[52] U.S. Cl. ..... 264/129; 264/130; 264/206; 264/211.17

[58] Field of Search ..... 264/130, 206, 211.17, 264/129

[56] References Cited

U.S. PATENT DOCUMENTS

| | | | |
|---|---|---|---|
| 3,458,616 | 7/1969 | Guess, Jr. et al. | 264/204 |
| 4,224,269 | 9/1980 | Reinehr et al. | 264/206 |
| 4,457,884 | 7/1984 | Reinehr et al. | 264/168 |
| 4,622,195 | 11/1986 | Bueb et al. | 264/206 |
| 4,804,511 | 2/1989 | Piper et al. | 264/206 |
| 4,842,793 | 6/1989 | Reinehr et al. | 264/136 |

FOREIGN PATENT DOCUMENTS

| | | |
|---|---|---|
| 1760377 | 12/1971 | Fed. Rep. of Germany . |
| 2713456 | 9/1978 | Fed. Rep. of Germany . |
| 3225206 | 1/1984 | Fed. Rep. of Germany . |
| 3308657 | 9/1984 | Fed. Rep. of Germany . |
| 3424343 | 1/1986 | Fed. Rep. of Germany . |
| 3515091 | 10/1986 | Fed. Rep. of Germany . |
| 3630244 | 3/1988 | Fed. Rep. of Germany . |
| 3634753 | 3/1988 | Fed. Rep. of Germany . |
| 3832872 | 4/1990 | Fed. Rep. of Germany . |

*Primary Examiner*—Hubert C. Lorin

*Attorney, Agent, or Firm*—Sprung Horn Kramer & Woods

[57] ABSTRACT

A process for dry spinning of synthetic polymers, in particular PAN threads containing more than 85 wt. % acrylonitrile in the PAN (co)polymer, with high spinning chimney capacities of at least 20 kg PAN solid per spinning chimney and hour, using superheated steam as the spinning gas and with in-chimney finishing with water or aqueous finishes.

10 Claims, No Drawings

PAN DRY SPINNING PROCESS OF INCREASED SPINNING CHIMNEY CAPACITY USING SUPERHEATED STEAM AS THE SPINNING GAS MEDIUM

The invention relates to a process for dry spinning of synthetic polymers, in particular PAN threads containing more than 85 wt. % acrylonitrile in the PAN (co)-polymer, with high spinning chimney capacities of at least 20 kg PAN solid per spinning chimney and hour, using superheated steam as the spinning gas and with in-chimney finishing with water or aqueous finishes.

In the customary dry spinning of PAN fibres (containing more than 85 wt. % PAN, preferably more than 92 wt. % PAN), the spinning solution (in highly polar solVents, such as dimethylformamide or dimethylacetamide) is spun through nozzles into vertical spinning chimneys In this process, the spinning solution is heated to temperatures between 100° and 150° C. just before the nozzles. The chimney walls are heated to 150°–220° C. Hot air or an inert gas at temperatures of up to 400° C. is passed over the threads in the direction of the threads or transversely thereto. The oxygen content in the spinning gas should be as low as possible, in order to avoid discoloration of the strands and decomposition of the highly polar spinning solvent, e.g. dimethylformamide or dimethylacetamide. A large proportion of the solvent (e.g. dimethylformamide) vaporizes in the spinning chimney and is sucked off together with the spinning gas at the bottom at the end of the chimney. Nozzles with 200–2,000 bores are used, depending on the fineness of the thread. Annular nozzles with a uniform number per unit area are preferably used here. The compacted dry strands are taken off at a speed of 200–500 m/min. Below the spinning chimney, the spun goods are finished with an aqueous, or in the case of filament production with an oily, finish and wound onto bobbins. The capacity of such a dry spinning chimney is finally determined by the geometry of the industrial device and by the amount of heat supplied to the strands via the hot spinning gas and the radiation from the heated chimney walls (c.f. Ullmanns Enzyclopädie (Ullmann's Encyclopaedia) volume 11, page 329, right-hand column).

Spinning chimney capacities of about 8–15 kg PAN solid per spinning chimney and hour are as a rule achieved in the dry spinning of PAN fibers. Although spinning chimney capacities of more than 20 kg/h during dry spinning have already been disclosed in DE-AS 1 760 377, a maximum output of 32 kg/h is achieved in the process cited only with a special spinning head. In this process, the jets of spinning solution issuing from a nozzle which is subdivided cylindrically and concentrically and has in each case 1,000 spinning orifices are blown over with a gas stream of Kemp gas directed inwards towards the centre of the spinneret, the procedure preferably being carried out with different temperatures resulting from separate heating up of the spinning solution and the jets of spinning solution being discharged from the spinneret segments at different temperatures. At these high spinning chimney capacities spinning defects can obviously only be avoided by the complicated spinning head with different flow conditions of the spinning gas close to the nozzles and the different spinning solution temperatures.

The spinning chimney capacity L can be calculated from the total spinning titre $G_{ST}$ (dtex) as follows:

$$L = \frac{G_{ST}\,(dtex) \times \text{spinning take-off (m/min)} \times 60}{10{,}000 \cdot 1{,}000}\ [\text{kg/chimney/h}]$$

The total spinning titre $G_{ST}$ (dtex = g/10,000 m) can be calculated from the following equation:

$$G_{ST} = \frac{P \times U \times K \times 0.94 \times 10{,}000}{A \times 100}$$

where
$G_{ST}$ = total spinning titre (*dtex*)
$P$ = pump volume ($cm^3$)
$U$ = revolutions per minute ($min^{-1}$)
$K$ = concentration of the spinning solution ($g/cm^3$)
$A$ = take-off speed (m/min)
dry spinning shaft or spinning chimney are equivalent expressions Several processes for the continuous production of PAN fibres by the dry spinning method have recently been disclosed (c.f. e.g. DE 3 308 657, DE 3 225 266 and DE 3 630 245).

Following these processes for continuous after-treatment, it was therefore very desirable to adjust the capacity during dry spinning to these new after-treatment steps and if possible to increase it, i.e. to adjust the specific spinning chimney capacity to the after-treatment processes.

As is known to the expert, an increase in the capacity in the spinning chimney can be achieved chiefly via the nozzle hole number, the spinning take-off and the throughput and via the amount of heat made available to the threads. However, industrial limits are now imposed on the extension of these parameters. Thus e.g. for a given chimney geometry (chimney length and chimney diameter), the nozzle hole number cannot be increased and the spinning take-off and spinning solution throughput raised as desired because the strands then no longer dry, or stick together. Limits are likewise imposed on an increase in the amount of spinning gas because of the vibrations and turbulences occurring in the spinning chimney. In the case of air as the spinning gas, the spinning gas temperatures cannot be increased substantially above 400° C., because the region of spontaneous ignition of air/DMF mixtures in the explosive range is then entered and safety limits are therefore imposed. Chimney surface temperatures above 220° C. cause a source of ignition by thermal decomposition of the PAN which has come into contact with the internal wall of the chimney, and this ignites an air/DMF mixture in the explosive range. Exposure of the threads to high temperatures furthermore results in raw shade problems on entry into the ambient air. Another possibility is to enlarge the chimney dimensions (longer and wider spinning chimneys) and in this way to increase the specific supply of gas and energy in order to arrive at higher spinning chimney capacities. Nevertheless, natural limits are also imposed on this possibility. On the one hand it must be possible for such dry spinning devices to be operated, from the point of view of handling, easily and in an uncomplicated manner by the staff, for example in the case of initial spinning, during changing of the spinnerets and during elimination of spinning malfunctions, and on the other hand certain safety provisions, e.g. in respect of chimney fire and explosion hazards, must also be observed. All these considerations show the diverse ways in which an increase in the spinning chimney capacity depends on the given framework conditions.

The object of the present invention was to provide a dry spinning process for PAN fibres (homo- and (preferably) copolymers containing an acrylonitrile content of more than 85 wt. %, in particular ≧92 wt. %, in the polymer) with increased spinning chimney capacities of at least 20 kg PAN solid per spinning chimney and hour, which can be conducted as safely as possible and produces threads with a very good raw shade—in spite of high spinning capacities.

It has now been found, surprisingly, that the above object can be achieved if superheated steam is employed as the spinning gas medium and, for a given spinning chimney geometry, at least 0.09 kWh energy per $m^2$ heated chimney wall and per kg PAN solid is supplied to the strands. This specific energy consumption is composed of the energy of the spinning gas fed in and the electrical energy required to heat up the spinning chimney. Both energy consumptions can be indicated in kilowatts (kW) by attaching a snap-on ammeter to the corresponding units. In the case of determination of the spinning gas energy, the measurement is made directly after the heat exchanger used to heat up the steam. The amount of spinning steam is determined via appropriate measuring diaphragms. In the case of the circular chimneys used, the heated area of the chimney wall (in $m^2$) is calculated from the formula for a cylindrical area from the chimney length (m) × chimney diameter (m)$\times\pi$. The specific energy consumption stated of 0.09 kWhg per $m^2$ heated chimney wall and per kg PAN solid throughput represents the lower limit at which spinning which is still free from sticking is possible from spinnerets, still to be described in more detail, at chimney capacities of at least 20 kg PAN solid per spinning chimney and per hour. At a lower specific energy supply (c.f. table 1, examples no. 12 and 15) the defect quota in the spun goods rises considerably. The quality of the spun goods was determined in number of spinning defects per 100,000 spinning capillaries.

If the number of spinning defects is less than 10 per 100,000 capillaries, the spinning profile can be referred to as good. In normal dry spinning with spinning chimney capacities of about 10 kg PAN solid per spinning chimney and hour, the specific energy consumption in the case of air as the spinning gas medium is about 0.05 kWh per $m^2$ heating area and per kg PAN solid.

From the problems described above in respect of the chimney fire, explosion and pyrolysis hazard in overheating PAN threads, the energy supply thus cannot be merely increased to the desired degree in order to increase the spinning chimney capacity to 20 kg PAN solid/hour. Further details of the burning properties and burning mechanism of PAN fibres are described e.g. in Melliand Textilberichte 53 (1972), pages 1395–1402, in particular page 1400, and 58 (1977), pages 52–59, in particular page 55. Thus e.g. the ignition point of PAN fibres is 245° C. (c.f. Chemiefasern/Text-industrie July 1972, page 611, right-hand column: Thermische Kennwerte von Faser-stoffen (Thermal Parameters of Fibre Materials). Slow decomposition of PAN fibres occurs here, toxic pyrolysis products also being formed.

It has now been found, surprisingly, that in spite of a high specific energy supply of at least 0.09 kWh/$m^2$ heating area per kg PAN, which initially does not appear to be reasonably realizable industrially for the abovementioned reasons, dry spinning can nevertheless be carried out with a high spinning chimney capacity of at least 20 kg PAN solid/hour if not only is superheated steam used as the spinning gas, but the thread temperature of the strands is reduced while these are still within the hot spinning chimney, preferably in the lower region of the chimney, by charging with water or an aqueous oil-containing finish, to the extent that the temperature of the strands is below 135° C., preferably below 130° C., before they leave the chimney and come into contact with atmospheric oxygen, and superheated steam prepared in practically droplet-free form is used in certain amounts as the spinning gas. In the PAN dry spinning process, the first finishing is usually carried out outside the chimney before discharge into the spinning can. In this context compare R. Kleber: Avivagen und Avivierungsmethoden bei Chemie-Schnittfasern und -kabeln (Finishes and Finishing Methods for Chopped Chemical Fibres and Tows), Melliand Textilberichte 3/1977, pages 187–194, in particular page 188, top. A suitable device for finishing the strands is described in more detail e.g. in the Application DE 3 515 091. The minimum amount of moisture which is needed to cool the threads to temperatures below 135° C. and still to achieve a usable tape closure of the individual threads for further processing, e.g. in a continuous process or for winding onto a bobbin, is at least 10.0 wt. %, based on the PAN solid. At lower amounts of moisture, fluffy material which tends to coil is obtained. (For further details compare table 2.)

If, as mentioned above, the thread temperature of the spun goods does not fall below 135° C., the occurrence of sticking, as described above, is observed at higher thread temperatures. As the thread temperatures increase further, (on exit into air) severe yellowing and where appropriate subsequent spontaneous ignition occur.

The temperature of the strands was measured without contact using a KT 15 radiation thermometer (manufacturer Heimann GmbH, Wiesbaden, FRG) directly after exit of the threads from the spinning chimney. The production of PAN threads by the dry spinning process using superheated steam has indeed already been mentioned earlier in the prior art (DE-AS 1 012 027). However, no rule for industrial handling for production of PAN fibres with a minimum chimney capacity of 20 kg PAN solid per hour can be deduced from the known process, since the Auslegeschrift cited contains no examples at all. Furthermore, the process according to the doctrine of main claim 1 could not be repeated, since carbonization and static charging of the threads during bundling or on contact with metallic components of the chimney occur when PAN threads are subjected to dry spinning in a superheated steam atmosphere. This disadvantage and the not unproblematic treatment of the spun goods can now be avoided, surprisingly, by finishing of the spun goods within the chimney before contact of the strands with atmospheric oxygen, the strands being cooled to thread temperatures below 135° C., preferably below 130° C.

A steam spinning process which is suitable for the production of hydrophilic PAN fibres but which uses saturated steam (not superheated steam as claimed according to the invention) has furthermore been disclosed In DE-A-27 13 456. In the process cited, however, matted, hydrophilic threads with a core-jacket structure and a circular cross-section are obtained, instead of the dumb-bell shape and compact fibres otherwise customary in dry spinning. If saturated steam is employed, under low energy conditions in the chimney (low chimney and air temperature) the steam acts not only as a spinning gas for taking up DMF from the PAN spinning solution, but also as a precipitating agent for the polyacrylonitrile, since water is a non-solvent for polyacrylonitrile. A jacket of relatively high density is formed on the outer surface of the threads as a result of polyacrylonitrile precipitation, so that further spinning solvent diffuses from the inside of the thread outwards into the chimney only with more difficulty. The threads with a highly solvent-containing core-jacket structure must be freed from the solvent by irrigation.

Spinning in a superheated steam atmosphere has still further advantages which have been utilized according to the invention to increase the spinning chimney capacity:

(a) With dry spinning using superheated steam, in comparison with air a higher energy supply is possible for the same spinning gas volume.

(b) As a result of the absence of oxygen in the spinning chimney, higher spinning gas and chimney temperatures are possible (e.g. spinning steam temperatures >360° C., preferably ≧400° C., chimney temperatures ≧240° C., whereas chimney temperatures >220° C. otherwise already lead to ignition hazards in the polymer).

(c) Extremely low residual solvent contents are obtained by the process according to the invention for steam spinning, in spite of the very high spinning chimney capacities of at least 20 kg PAN solid per hour and chimney. This means that according to the invention a very low spinning defect quota is obtained, in spite of the high capacity spinning. In contrast, threads richer in solvent according to the prior art which have been spun from high hole numbers have a great tendency to stick together Steam shows definite advantages over air or nitrogen or other inert gases here.

During dry spinning, the spinning gas is in general fed in above the spinneret in parallel flow with the strands. As spinning experiments with spinning chimney capacities of at least 20 kg PAN solid/hour have shown, amounts of steam of at least 50 kg/hour are needed at these spinning chimney capacities in order to keep the defect rate during spinning below 10 per 100,000 capillaries (c.f. table 1, example 9).

Spinning is in general carried out via nozzles with high hole numbers, preferably annular nozzles with bores distributed over several hole collars.

The hole density L has a further influence in dry spinning. The hole density L is defined as the number of nozzle holes per $cm^3$ nozzle area. The smaller the hole separation over the nozzle area, the more difficulty the spinning gas medium has in reaching the individual threads. Surprisingly, annular spinnerets with a perforated nozzle with a hole density L of $10.5/cm^2$ can still be employed successfully in spinning with superheated steam. Hole densities L of between 4 and 6 holes/$cm^2$ are usually customary in dry spinning from annular nozzles.

In a further preferred embodiment of dry spinning, the spinning gas is fed into the upper section of the chimney and then flows via a cylindrical gas distributor with a cylinder wall which is permeable to gas to the threads from the inside outwards (c.f. DE-A-3 424 343). As corresponding spinning experiments with air as the spinning gas have shown, considerable disturbances in the spinning, in the form of titre variations, sticking and thick and thin points on the filaments, occur with annular nozzles with more than about 1,200 holes and hole densities greater than 6 holes/$cm^2$ if the spinning chimney capacity is to be increased to >20 kg/hour (c.f. Patent Application Le A 25 998 (P 38 32 872.0) filed at the same time).

If corresponding spinning experiments are now carried out with superheated steam (according to the invention) instead of air, it is to be found, completely unexpectedly, that spinning chimney capacities above 20 kg PAN solid per hour and chimney can also be achieved with a very good spinning profile by spinning with cylindrical gas distributors from spinnerets with a very high hole number (e.g. 1,638 holes; c.f. example 2) and a considerably higher hole density. If the superheated spinning steam is blown onto the strands transversely to the thread direction (c.f. table 1, example 13), 40 kg/h superheated steam are already sufficient to achieve a perfect spinning profile. The fact that less spinning steam is required for spinning with transverse blowing over the strands is also based on the intensive blowing onto the strands during transverse flow, as is demonstrated in more detail below on the basis of temperature and DMF content measurements on the spun goods.

During steam spinning of PAN fibres and threads it should furthermore be ensured that the superheated spinning steam employed is completely free from water. Drops of water interfere with the spinning process and lead to tearing off of bundles of fibre bunches below the nozzle. Droplet-free spinning steam is obtained by e.g. dehydrating and reducing 15 bar mains steam, subsequently charging it via a heat exchanger and only then feeding it to the spinning chimney. In addition to this improved spinning behaviour at a high spinning chimney capacity, considerably lower solvent values (e.g. DMF values) in the spun goods are found as a further advantage in a superheated steam atmosphere in comparison with normal dry spinning. In spite of high spinning chimney capacities of more than 20 kg PAN solid per hour, the DMF values in the spun goods are below 20 wt. %. As temperature measurements close to the nozzle have shown in on-going spinning experiments with the same experimental settings, the temperature of the spinning steam using the cylindrical gas distributors with a cylinder surface which is permeable to gas is 3020 -40° C. lower with transverse flow of the spinning gas than in the spinning process with the spinning steam fed in parallel to the running direction of the thread. Thus e.g. the hot spinning steam at 400° C., according to example 1, cools to about 170° C. close to the nozzle after DMF saturation and with parallel flow to the threads, whereas with transverse flow to the threads only 135° C. was measured. This phenomenon can be explained by the fact that more intensive removal of DMF from the strands takes place with transverse blowing over the threads. The spinning gas medium therefore cools correspondingly more. This finding is of such great importance because sticking of individual capillaries in the form of so-called bristles can very easily occur at high DMF values in the spun goods. During spinning at high chimney capacities from high hole numbers, as is known to the expert, more spinning solvent must necessarily be vaporized. Because of the more intensive expulsion of DMF with spinning steam instead of air, threads with a lower defect quota can now therefore be produced in spite of the very high spinning chimney capacities.

The invention thus relates in particular to a process for the production of PAN fibres by the dry spinning method using steam as the spinning gas medium, characterized in that spinning is carried out to give improved spinning chimney capacities of at least 20 kg PAN solid per spinning chimney and hour from nozzles with high hole numbers, the spinning gas being blown from the top downwards parallel or transversely to the direction of the bunch of threads, at spinning defect quotas of less than 10 per 100,000 filaments and at DMF contents in the spun goods of <20 wt. %, preferably <15 wt. %, wherein (a) the hole density of the annular spinnerets is not more than 10.5 holes per $cm^2$ annular spinneret area, (b) the hole separation of the annular nozzle is at least 2.8 mm, (c) the chimney wall temperature is at least 225° C., preferably at least 240° C., (d) the specific energy consumption is at least 0.09 kWh per kg PAN solid per $m^2$ heating area, (e) the superheated steam has a temperature of at least 400° C. and the superheated steam is prepared in practically droplet-free form, (f) the amount of steam employed is at least 40 kg/h for transverse blowing with superheated steam and at least 50 kg/h for parallel introduction of the steam, (g) finishing of the threads already takes place within the spinning chimney, preferably with water or an aqueous oil-containing finish, (h) the minimum amount of moisture is more than 10 wt. %, based on the PAN solid, moistening of the threads taking place during bundling for the purpose of tape closure, and (i) the temperature of the strands, measured at the chimney output, is below 135° C., preferably below 130° C.

(k) the solvent (dimethylformamide) content of the strands leaving the chimney is <10% by weight, in particular 2 to <10%, based on the PAN solids.

The following examples serve to explain the invention in more detail, without limiting it themselves. Unless noted otherwise, all the percentage data relate to the weight.

The Berger degree of whiteness $W_B$ was determined by measurement of the standard colour values X, Y, Z on a Hunter three-filter photometer. The following relationship applies:

$$W_B = R_Y + 3(R_Z - R_X)$$

$$X = 0.783 R_X + 0.198 R_Z$$

$$Z = 1.182 R_Z$$

Threads according to the process are claimed, having a Berger degree of whiteness, measured on spun goods, of greater than 50.

EXAMPLE 1

An acrylonitrile copolymer with a K value of 83 of 93.6 wt. % acrylonitrile, 5.7 wt. % methyl acrylate and 0.7 wt. % sodium methallylsulphonate is dissolved in dimethylformamide at 80° C. so that a 29.5% spinning solution of solid (based on the amount of solvent) is formed. The spinning solution was heated up to 135° C. in a pre-heater and spun from an annular spinneret with 1,638 holes, distributed over 13 collars of 126 holes each. The minimum hole separation is 3.2 mm. The hole density L is 8.6 holes per $cm^2$ and the circular nozzle bores had a diameter of 0.2 mm. A flow of hot superheated steam at 400° C. was passed over the strands parallel to the running direction of the threads. 50 kg superheated steam per hour were charged through the spinning chimney as the spinning gas. The heated spinning chimney area is 7.6 $m^2$. Spinning was carried out at a chimney temperature of 240° C. 1,403 $cm^3$/min spinning solution were forced through the chimney. The threads were taken off at 250 m/min and still within the spinning chimney were bundled via 2 Y-shaped forks opposite one another and at different heights (according to DE-A-3 424 343), and at the same time wetted with water such that the moisture of the threads makes up 20.5 wt. %., based on the solids content. The strands leave the spinning chimney at a thread temperature of about 102° C. The spinning chimney capacity for the spinning titre achieved of 9.5 dtex was 23.3 kg PAN solid per hour. The spun goods had, over 20 measurements, less than 5 defects per 100,000 capillaries, defects being evaluated as: sticking and thick and thin filaments. The DMF content in the spun goods was 7.9%. The Berger degree of whiteness is 50.1. The energy consumption of the spinning gas, measured downstream of the air heater before entry into the spinning chimney, is 8.5 kWh and the energy consumption of the heated chimney walls was measured as 8.8 kWh. From this, a specific energy consumption of 0.097 kWh per kg PAN solid and per $m^2$ heated spinning chimney are deduced.

EXAMPLE 2

A PAN spinning solution prepared according to example 1 is again spun from an annular spinneret with 1,638 holes and a hole density of 8.6 holes per $cm^2$. A flow of hot (superheated) steam at 400° C. was passed over the strands, but transversely from the inside outwards, a hollow cylinder with a cylinder surface which was permeable to as and had a diameter of 85 mm and a length of 95 mm serving to distribute the spinning gas. The bottom of the cylinder was closed with a metal plate 51 kg superheated steam per hour were employed as the spinning gas. The heated spinning chimney area is 7.6 $m^2$. Spinning was again carried out at a chimney temperature of 240° C. 1,623 $cm^3$/min spinning solution were forced through the chimney. The threads were taken off at 300 m/min, and still within the spinning chimney were wetted with water, as described in example 1, such that the moisture content of the threads makes up 15.5 wt. %, based on the solids content. The strands left the spinning chimney with a thread temperature of about 122° C. The spinning chimney capacity for the spinning titre achieved of 9.1 dtex was 27.0 kg PAN solid per hour. The spun goods had (over 20 measurements) less than 10 defects per 100,000 capillaries. The DMF content in the spun goods was only 7.2%, in spite of the higher spinning chimney capacity in comparison with example 1. The Berger degree of whiteness is 53.5. The energy consumption of the heated chimney walls was measured as 13,4 kWh. From this, a specific energy consumption of 0.107 kWh per kg PAN solid per $m^2$ heated spinning chimney area is deduced.

Further spinning experiments are listed in the following table 1, a polyacrylonitrile spinning solution according to example 1 and spinning devices according to example 1 or 2 having been used. The parameters which have been changed in comparison with examples 1 and 2 can be seen from the table.

As can be seen from table 1, the process is suitable for the production of the most diverse spinning titres (c.f. examples 1, 2, 5 and 6). At spinning titres up to about 10 dtex, hole numbers above 1,000, preferably above 1,500 (up to about 2,500), are particularly preferred. At spinning titres up to about 20 dtex, hole numbers above 1,000 (up to about 2,000) and at spinning titres above 30 dtex hole numbers >500 (up to about 1,500) are preferably employed. Example 4 shows that spinning chimney capacities of e.g. more than 30 kg PAN solid/hour can be realized without problems. Example 7 shows that if the hole separation is too low (2.5 mm), in spite of a low hole density the number of stickings increases greatly (possibly because the spinning gas no longer reaches all the strands. In example 8 it is demonstrated that if the hole separation is sufficiently high (=2.8 mm) but the hole density L is too high (L=11.5), likewise no good spinning profile is achieved. In example 9, the amount of spinning gas of 40 kg/hour is no longer sufficient to produce spinning chimney capacities greater than 20 kg PAN solid/hour (increase in the spinning defect quota). In the case of example 10, it is shown that if the spinning gas temperature is too low the number of spinning defects in the form of sticking increases greatly. The conditions close to the nozzle are evidently decisive during thread formation. As the spinning gas temperature increases further, the spinning profile in fact can be improved quite decisively (c.f. example 11). In the case of example 12, the specific energy consumption of 0.075 kWh per kg PAN solid and per $m^2$ heating area is no longer sufficient to produce perfect spinning behaviour. Example 13 with transverse blowing of the spinning steam onto the fibre bunch demonstrates that even with 40 kg spinning steam per hour, spinning chimney capacities greater than 20 kg PAN solid per hour can still be achieved with a good spinning flow when this device is used for spinning. Example 14 shows that if the hole density is too high at $L/cm^2=11.5$, the number of stickings also increases greatly here because the spinning gas no longer reaches all the threads. Finally, example 15 shows that if the amount of spinning gas is too low, the spinning defect quota is very high.

EXAMPLE 3 (COMPARISON)

(a) A PAN spinning solution prepared according to example 1 was spun as described in that example. However, the strands were not finished with water in the lower end of the spinning chimney. The threads discoloured to yellow-brown in air and started to glow on the winding device. At the same time, thread tear-offs constantly occurred. The capillaries were rough and hard and had a high tape rigidity. The thread temperature was 158° C. The glowing bobbin developed a caustic, pungent smell and was extinguished immediately with water.

(b) Threads according to example 3a were finished with water or with an aqueous oil-containing finish outside the spinning chimney. Thread tear-offs and pushing on constantly occurred between the chimney end and the finishing and winding device. At the same time, the threads were sometimes stuck to one another.

(c) In another series of experiments, the finishing amount of water or of an aqueous finish containing an antistatic and lubricant was determined on strands produced according to example 1, and the thread temperature was measured directly after leaving the spinning chimney. The spinning course was furthermore evaluated. A mixture of a lubricant and an antistatic with a concentration of 40 g/l was used as the finish. Suitable lubricants are e.g. glycols, silicones or ethoxylated fatty acids, alcohols, esters, amides and alkyl ether-sulphates. Suitable antistatics are e.g. cationic, anionic or nonionic compounds, such as e.g. long-chain ethoxylated, sulphated and neutralized alcohols.

Further examples according to table 1 are listed therein under the designation of number plus suffix (t1).

TABLE 1

| Examples .t1 | 1t1 | 2t1 | 3t1 | 4t1 | 5t1 | 6t1 | 7t1 | 8t1 |
|---|---|---|---|---|---|---|---|---|
| Nozzle hole number | 2002 | 2002 | 1638 | 1638 | 1155 | 592 | 2400 | 1264 |
| Hole density $L/cm^2$ | 10.5 | 10.5 | 8.6 | 8.6 | 6.0 | 3.1 | 12.6 | 11.5 |
| Min. hole separation mm | 2.8 | 2.8 | 3.2 | 3.2 | 3.8 | 5.4 | 2.5 | 2.8 |
| Spinning take-off m/min | 350 | 200 | 300 | 350 | 200 | 200 | 200 | 350 |
| Throughput sp. soln. $cm^3$/min | 1313 | 1380 | 1621 | 1844 | 1673 | 1464 | 1640 | 11873 |
| Spinning gas direction | vert. | vert. | vert. | vert. | vert. | vert. | vert. | vert. |
| Spinning gas amount kg/h | 50 | 50 | 50 | 50 | 50 | 50 | 50 | 50 |
| Spinning gas temp. °C. | 400 | 400 | 400 | 400 | 400 | 400 | 400 | 400 |
| Chimney temp. °C. | 240 | 240 | 240 | 240 | 240 | 240 | 240 | 240 |
| Thread temp. °C. | 125 | 120 | 127 | 117 | 101 | 97 | 109 | 101 |
| Spinning titre dtex | 5.2 | 9.6 | 9.1 | 8.9 | 20.0 | 34.3 | 9.5 | 8.6 |
| Total titre dtex | 10410 | 19150 | 14980 | 14610 | 23200 | 20300 | 22740 | 10880 |
| Moisture content threads % | 12.9 | 15.0 | 10.9 | 18.3 | 21.3 | 25.7 | 19.1 | 21.1 |
| DMF content threads % | 6.6 | 11.2 | 11.8 | 13.6 | 11.6 | 14.9 | 5.8 | 9.0 |
| Berger degree of whiteness | 59.9 | 51.0 | 52.3 | 53.0 | 51.1 | 50.2 | 51.4 | 51.3 |
| Defects per 100,000 cap. | 10 | 10 | 5 | 5 | 5 | 2 | 100 | 100 |
| Capacity kg PAN/h | 21.9 | 23.0 | 27.0 | 30.7 | 27.8 | 24.4 | 27.3 | 22.8 |
| Energy spinning gas kWh | 8.5 | 8.5 | 8.5 | 8.5 | 8.5 | 8.5 | 8.5 | 8.5 |
| Energy chimney kWh | 8.0 | 8.3 | 13.4 | 14.6 | 13.7 | 9.8 | 12.9 | 8.1 |
| Specic. energy consumption kWh per kg PAN per $m^2$ heating area | 0.099 | 0.096 | 0.107 | 0.099 | 0.105 | 0.098 | 0.103 | 0.095 |
| Comments | acc. to invention | acc. to invention | acc. to invention | acc. to invention | acc. to invention | acc. to invention | not acc. to invention | not acc. to invention |

| Examples .t1 | 9t1 | 10t1 | 11t1 | 12t1 | 13t1 | 14t1 | 15t1 |
|---|---|---|---|---|---|---|---|
| Nozzle hole number | 1638 | 1638 | 1638 | 1638 | 1380 | 1264 | 1638 |
| Hole density $L/cm^2$ | 8.6 | 8.6 | 8.6 | 8.6 | 7.2 | 11.5 | 8.6 |
| Min. hole separation mm | 3.2 | 3.2 | 3.2 | 3.2 | 3.5 | 2.8 | 3.2 |
| Spinning take-off m/min | 250 | 300 | 300 | 350 | 350 | 300 | 300 |
| Throughput sp. soln. $cm^3$/min | 1401 | 1621 | 1620 | 1844 | 1535 | 1176 | 1568 |
| Spinning gas direction | vert. | vert. | vert. | vert. | trans. | trans. | trans. |
| Spinning gas amount kg/h | 40 | 50 | 50 | 50 | 40 | 40 | 30 |
| Spinning gas temp. °C. | 400 | 360 | 420 | 400 | 400 | 400 | 400 |

TABLE 1-continued

| | | | | | | | |
|---|---|---|---|---|---|---|---|
| Chimney temp. °C. | 240 | 240 | 240 | 220 | 240 | 240 | 240 |
| Thread temp. °C. | 119 | 98 | 122 | 124 | 121 | 115 | 118 |
| Spinning titre dtex | 9.5 | 9.1 | 9.1 | 8.9 | 8.8 | 8.6 | 9.1 |
| Total titre dtex | 15540 | 14980 | 14970 | 14610 | 12160 | 10870 | 14490 |
| Moisture content threads % | 17.6 | 22.4 | 13.3 | 12.4 | 14.1 | 18.6 | 16.0 |
| DMF content threads % | 13.3 | 14.2 | 7.9 | 21.4 | 9.7 | 8.2 | 15.1 |
| Berger degree of whiteness | 52.5 | 53.2 | 50.3 | 54.3 | 53.5 | 50.8 | 52.8 |
| Defects per 100,000 cap. | 100 | 50 | 5 | 100 | 5 | 100 | 100 |
| Capacity kg PAN/h | 23.3 | 27.0 | 27.0 | 30.7 | 25.5 | 19.6 | 27.0 |
| Energy spinning gas kWh | 7.2 | 7.3 | 9.1 | 8.5 | 7.2 | 7.2 | 4.9 |
| Energy chimney kWh | 15.7 | 14.5 | 12.6 | 8.9 | 11.1 | 9.6 | 13.4 |
| Specic. energy consumption kWh per kg PAN per $m^2$ heating area | 0.129 | 0.106 | 0.105 | 0.075 | 0.094 | 0.113 | 0.089 |
| Comments | not acc. to invention | not acc. to invention | acc. to invention | not acc. to invention | acc. to invention | not acc. to invention | not acc. to invention |

As can be seen from table 2 (experiments with suffix t2), the moisture content of the strands should be more than 10 wt. %, based on the PAN solid, for the purpose of good further processing. As spinning experiments with other titres, according to examples 5t2 and 6t2 in table 2, show, this minimum amount of finishing agent is always necessary in order to achieve a good spinning course with tape closure without pushing up and capillary breaks. At thread temperatures above 135° C., increased tape rigidity occurs. The capillaries become rough and embrittled and tape closure no longer exists.

TABLE 2

| Example no. .t2 | 1*t2 | 2*t2 | 3t2 | 4t2 | 5t2 | 6t2 | 7t2 | 8t2 |
|---|---|---|---|---|---|---|---|---|
| Finish | water | water | water | water | fin. | fin. | fin. | fin. |
| Amount ml/min | 50 | 40 | 30 | 25 | 50 | 40 | 30 | 25 |
| Moisture content % of the threads | 12.4 | 10.2 | 8.1 | 6.8 | 12.5 | 10.7 | 8.6 | 7.1 |
| Oil application % to the threads | — | — | — | — | 0.20 | 0.16 | 0.13 | 0.11 |
| Thread temp. °C. | 126 | 130 | 137 | 143 | 128 | 132 | 136 | 141 |
| Spinning course | Good bobbin flow and further proc. | bobbin flow still in order | rough brittle cap. fluffy start tape rigidity | rough brittle cap. no tape closure | good bobbin flow and further proc. | start of tape rigidity | rough brittle cap. fluffy | rough brittle cap. no tape closure |
| Comments | *acc. to invention | *acc. to invention | not acc. to invention | not acc. to invention | *still acc. to invention | *acc. to invention | not acc. to invention | not acc. to invention |

Tape closure is understood as that state in which, after wetting and subsequent bundling in the spinning chimney, the individual capillaries are present as a closed, homogeneous association without tangling of the individual threads and without individual threads splitting off during winding off or deflection.

The make-up of strands into homogeneous layers parallel to one another within the spinning tape without tangles, characterized as tape closure, is of great industrial importance. This can also be seen e.g. from DE-A-3 726 211, where a spinning-moist, wet-spun acrylic tow is dried after the precipitation process under a shrinkage allowance of 5–15% to 100–10 wt. % moisture content while retaining the gel structure of the threads, so that it can then be further after-treated more easily without thread breaks to give carbon fibres. In the spinning-moist and non-dry—so that they are also not tangled or cannot stick to one another through spinning solvent influences.

In dry spinning, on the other hand, according to the invention the previously dried threads containing only residual solvent are moistened before bundling in order to prevent pushing up of threads, abrasion and electrostatic charging. The fact that during bundling of the threads without prior moistening, as a result of the high energy data which are now possible in the process according to the invention (e.g. at a chimney temp. = 240° C., steam temp. = 400° C.) sticking of the threads to one another to form bristles, the residual spinning solvent acting like an adhesive for the fibre bunch, can very easily occur presents problems. This is prevented according to the invention by already carrying out the moistening of the strands in the spinning chimney before the actual bundling.

It was very surprising, that just in the water vapour phase the thermo-decomposition of the PAN-solvents, such as dimethylformamide, are drastically reduced in number and concentration of decomposition compounds. The number of decomposition products is reduced by a factor of about 10.

The expectation was quite different: it was expected, that the water vapour at the high temperatures would lead to a drastic hydrolytic decomposition of dimethyl formamide.

The examination of the condensate of spinning gas and spinning solvent in the spinning solvent condensor (water cooling see table 3) and of the spinning gas after the condensor (see table 4) resulted in favourably reduced quantities of decomposition compounds, when the water vapour spinning process was investigated. It is thus found, that on hot air spinning (state of the art) a 30-fold higher quantity of formaldehyde, and about 100-fold higher quantity of formic acid, and about 10-fcld quantity of ammonium and an appreciably higher amount of dimethylamine is found, compared to the process of our invention.

These results are of very high ecological relevance,

The examples according to tables 3 and 4 were conducted with the same spinning shaft productivity and at the same spinning gas temperature of 400° C.

The investigation of the spinning (waste gas) was made by quantitative measurements of part of the gas stream by condensation in low temperature traps (liquid nitrogen).

It is of great importance, that with water vapour gas spinning, according to the invention, no N-nitrosoamine compounds were found.

TABLE 3

Investigation of the condensor-condensate (condensation of solvent (DMF) - coolant in the condensor is water)

| spinning process | formaldehyde (mg/l) | formic acid (mg/l) | dimethylamine (mg/l) |
|---|---|---|---|
| spinning with hot air (state of the art) | 2-3 | 170-172 | 12-13 |
| spinning with water vapour (according to the invention) | <2 | 21-23 | <0,001 |

The results refer to milligrams, found per liter of condensate of spinning solvent coming from the spinning shaft.
In the case of spinning with hot air a 10-fold higher quantity of (most unidentified) further decomposition products is found when spinning with water vapour.

TABLE 4

Investigation of the spinning gas after the passing the (spinning solvent) condensor

| spinning process | formal-dehyde ($mg/Nm^3$) | formic acid ($mg/Nm^3$) | dimethyl-amine ($mg/Nm^3$) | ammonia ($mg/Nm^3$) |
|---|---|---|---|---|
| spinning with hot air (state of the art) | 31-35 | <0,16 | 5,8-8,5 | 11-13 |
| spinning with water vapour (according to the invention) | 0,47-0,95 | 0,35 | 1,8-2,0 | 0,04-0,95 |

$Nm^3$ is normal cubic meter of waste gas (spinning gas)

We claim:

1. In the production of PAN fibers by dry spinning a solution of the PAN in a solvent using steam as a spinning gas medium, the spinning being carried out to give an improved spinning chimney capacity of at least 20 kg PAN solid per spinning chimney per hour from a nozzle with a high number of holes, the steam being blown from the top downwards parallel or transversely to the direction of the fibers at a spinning defect quota of less than 10 per 100,000 filament and at a solvent content in the spun fibers of <20 wt. %, the improvement wherein (a) the nozzle has holes arranged annularly with a hole density of not more than 10.5 holes per $cm^2$ of annular spinneret area, (b) the hole separation of the annular nozzle is at least 2.8 mm, (c) the chimney wall temperature is at least 225° C., (d) the specific energy consumption is at least 0.09 kWh per kg PAN solid per $m^2$ heating area, (e) the superheated steam has a temperature of at least 400° C. and the superheated steam is prepared in practically droplet-free form, (f) the amount of steam employed is at least 40 kg/h for blowing transverse to the direction of the fibers, (g) finishing of the threads takes place within the spinning chimney, (h) the minimum amount of moisture is more than 10 wt. %, based on the PAN solid, the threads being bundled and moistened, (i) the temperature of the fibers, measured at the chimney output, is below 135° C.

2. The process according to claim 1, wherein in (f) at least 50 kg/h of the steam is blown parallel to the direction of the fibers.

3. The process according to claim 1, wherein the steam employed is practically droplet-free, being subjected to dehydration, relaxation and after-heating via heat exchange before entry into the spinning chimney.

4. The process according to claim 1, wherein the resultant fibers are up to 10 dtex, the annular nozzle having from 1,500 to 2,500 holes.

5. The process according to claim 1, wherein the resultant fibers are from 10 to 20 dtex, the annular nozzle having from 1000 to 2000 holes.

6. The process according to claim 1, wherein the resultant fibers are above 30 dtex, the annular nozzle having from 500 to 1,500 holes.

7. The process according to claim 1, wherein the PAN solvent is DMF and its content in the spun fiber is <1% by weight.

8. The process according to claim 1, wherein the chimney wall temperature is at least 240° C.

9. The process according to claim 1, wherein in stage (i) the temperature of the fibers at the output is below 130° C.

10. The process according to claim 1, wherein the PAN solvent is DMF and its content in the spun fiber after leaving the spinning chimney is from 2 to 10 wt. %.

* * * * *